US006688469B1

(12) United States Patent
Barnes

(10) Patent No.: US 6,688,469 B1
(45) Date of Patent: Feb. 10, 2004

(54) FOOD CONTAINER

(76) Inventor: Susan Marie Barnes, 1 Edmund Rd. Chafford Hundred, Essex (GB), RM16 6HA ( * ) Notice: Subject to any disclaimer, the term of this patent is extended or adjusted under 35 U.S.C. 154(b) by 0 days.

(21) Appl. No.: 10/009,393

(22) PCT Filed: May 16, 2000

(86) PCT No.: PCT/GB00/01786

§ 371 (c)(1),
(2), (4) Date: Nov. 13, 2001

(87) PCT Pub. No.: WO00/69728

PCT Pub. Date: Nov. 23, 2000

(30) Foreign Application Priority Data

May 17, 1999 (GB) ..... 9911332

(51) Int. Cl.[7] ..... A45C 11/20

(52) U.S. Cl. ..... 206/541; 206/217; 206/497; 220/212; 220/710; D7/643; D9/337

(58) Field of Search ..... 206/217, 223, 206/541, 542, 497, 216; 215/388, 389; 220/705, 710, 212, 574.1, 735; D9/436, 337, 38; D7/643, 507, 509, 511, 513

(56) References Cited

U.S. PATENT DOCUMENTS 3,332,567 A * 7/1967 Pugh ..... 215/388
4,043,478 A * 8/1977 Duncan ..... 220/710
4,573,631 A * 3/1986 Reeves ..... 229/404
5,054,631 A * 10/1991 Robbins, III ..... 215/389
5,353,983 A * 10/1994 Miller ..... 229/103.1
5,460,264 A * 10/1995 Rupert ..... 206/217

FOREIGN PATENT DOCUMENTS

GB 2300172 A * 10/1996 ..... B65D/77/24
JP 09255031 A * 9/1997 ..... B65D/77/04

* cited by examiner

*Primary Examiner*—Jila M. Mohandesi
(74) *Attorney, Agent, or Firm*—Andrus, Sceales, Starke & Sawall, LLP

(57) ABSTRACT

A molded plastics pot (10) for containing food has a base (13) and a side wall (14). A plastic utensil such as a spoon (16) to assist the consumption of food contained in the pot (10) is molded integrally with the pot, and is hinged by the end of the handle (17) to the upper or lower end of the pot. The length of the utensil is more or less equal to the depth of the pot and the side wall (14) of the pot has a recess (15) in which the utensil can be accommodated, nibs (20) serving to retain the utensil in the recess until required for use. Then, the utensil (16) may be pulled out of the recess (15) and broken away from the hinge (18).

13 Claims, 5 Drawing Sheets

FOOD CONTAINER

CROSS-REFERENCE TO RELATED APPLICATIONS

This application is the U.S. national stage application of International Application PCT/GB00/01786, filed May 16, 2000, which international application was published on Nov. 23, 2000, as International Publication WO 00/69728 in the English language. The International Application claims priority of Great Britain Patent Application 9911332.6, filed May 17, 1999.

This invention relates to a food container, and in particular to a container which is adapted to facilitate the consumption of the contents of the container.

Many food products including snack foods are marketed in moulded plastics material containers. When a snack food consists of easy to handle pieces, the consumption of that food is relatively easy, by using the fingers. Semi-liquid, pastes or cream-like food-stuffs, such as cottage cheese, yoghurt, and so on, though eminently suitable for use as snack foods, are not so widely purchased for this purpose, in view of the difficulty of consuming them as an informal snack. Such food-stuffs cannot be eaten with the fingers, and a consumer has to provide a spoon or other utensil. Consequently, the likelihood of, say, a pot of yoghurt being purchased as an impulse-buy snack food is much reduced as the purchaser will not have a spoon readily available for the consumption of the yoghurt. Similar issues apply for certain types of savoury foods, such as those which merely require the addition of hot water—for example, noodles, pasta and soups.

To address the above problem, a shop may provide a free moulded plastics spoon or perhaps a wooden spatula. It is also known, for example with ice-cream tubs, to secure a spoon or other utensil to a container for example with self-adhesive tape so that a purchaser may have readily available a suitable utensil for consumption of the contents of the container. However, this proposal is inconvenient for the supplier, in that the attachment of the utensil to the container is difficult to achieve on a mechanised basis, and so tends to be costly. Moreover, there is a significant risk that the utensil will be detached either deliberately or inadvertently before the product is consumed.

The above problem has been addressed by securing a spoon internally within the lid of a container, so that access to the spoon may be gained once the container has been opened. However, this has the disadvantage that the length of the spoon is restricted to be less than the diameter of the container, which often is very significantly less than the depth of the container. In addition, and particularly for liquid or semi-liquid foodstuffs, the handle of the spoon is likely to have the foodstuff adhering thereto, and so will be unpleasant to use.

There have been other proposals, but generally the spoon is too short, or a folding spoon is employed, but this is very expensive to implement. Further, these solutions may have complex arrangements for retaining the spoon to the container.

In an attempt to address the above problems, this invention provides a food container in the form of a moulded plastics material pot having a base and a side wall upstanding from the base, in combination with a moulded plastics utensil to assist the consumption of the food contents of the container when sold, the container being of generally circular cross-sectional shape and having an integrally moulded outwardly-projecting rim, and the utensil being moulded integrally with the container and connected at one end thereof to the rim of the container, the length of the utensil substantially corresponding to the height of the container and the external surface of the container side wall having an inwardly-directed depression moulded therein to extend substantially from the rim of the container to the base wall of the container, the shape of which depression generally corresponds to that of said utensil so that prior to use the utensil may be located in the depression, and there being a covering for the depression which covering serves to retain the utensil in the depression and to protect the utensil from contamination.

It will be appreciated that with the food container of this invention, a utensil is provided with the container, located in an inwardly directed depression in the container wall. One end of the utensil is hingedly connected to the container rim and extends for essentially the full height of the container. Thus, a purchaser of the product will have a suitable utensil immediately available for the consumption of the container contents, which utensil may easily reach to the bottom of the container. This will enable the purchase of the product as an impulse-buy snack food, even though that product cannot be eaten simply with the fingers. The utensil is produced integrally with the container in an automated manner and so is relatively cheap to implement. Also, as the utensil does not project outwardly beyond the container to any great extent, the likelihood of any inadvertent or even deliberate unauthorized detachment is much reduced.

The utensil will have a handle, and it is highly preferred that the free end of the handle of the utensil is hingedly connected to the container rim. In the alternative, the free end of the handle may be hingedly connected to the container at or adjacent the rim of the container.

The hinged connection advantageously is by way of a moulded frangible hinge, whereby the utensil may be broken away from the container when the utensil is required for consuming the content. After manufacture by simultaneously moulding the container and the utensil the utensil may be hinged around so as to be located within the depression in the side wall, for storage there until the utensil is required for use.

Preferably the utensil is a press-fit in the depression in the container side wall, so that the utensil will be retained in the depression until required for use. To this end, the utensil may be a close fit within the edge of the depression, or there may be one or more inwardly directed nibs formed around the edge of the depression and behind which the utensil may be pressed, so as thereafter to be located and retained in the depression.

In addition, or as an alternative means for retaining the utensil in the depression, a label may be applied to the container wall, which label extends over the depression and so also over the utensil in the depression. Such a label may comprise a pre-printed self-adhesive panel, or may be in the form of a pre-printed shrink-wrap sleeve which is fitted to the container after the location of the utensil in the depression, the sleeve then being shrunk by the application of heat so as to grip the container.

Though the utensil provided with the container will usually comprise a spoon, for the consumption of semi-liquid or cream or paste-like food-stuffs, other utensils could be provided—for example, a fork, knife, stirring rod or a pair of chop sticks. Indeed, it would be possible to provide the container with more than one depression, spaced around the periphery of the container wall, with a different utensil located in each such depression.

This invention extends to a packaged food-stuff in a combination of a food container and a utensil of this invention as described above.

By way of example only, one specific embodiment of container of this invention will now be described in detail by way of the accompanying drawings, in which.

Figure 2:
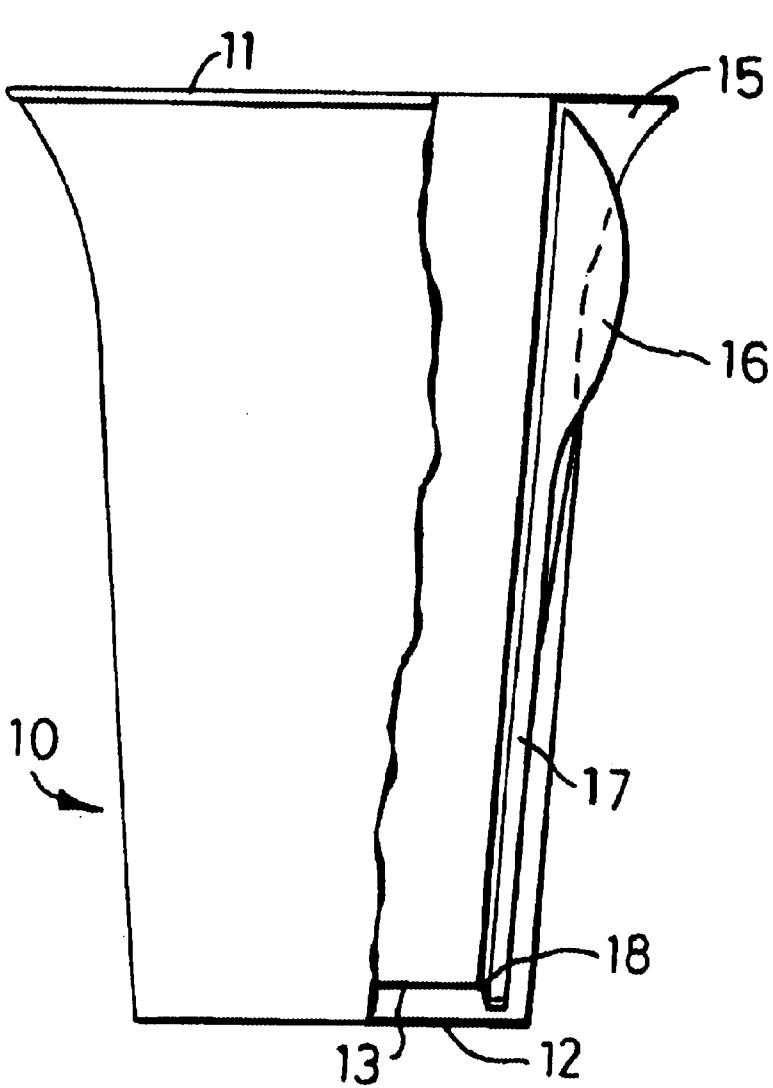
FIG. 2 is a further side view, taken at 90° to the view of FIG. 1, but with side of the side wall cut away for clarity.
Figure 1:
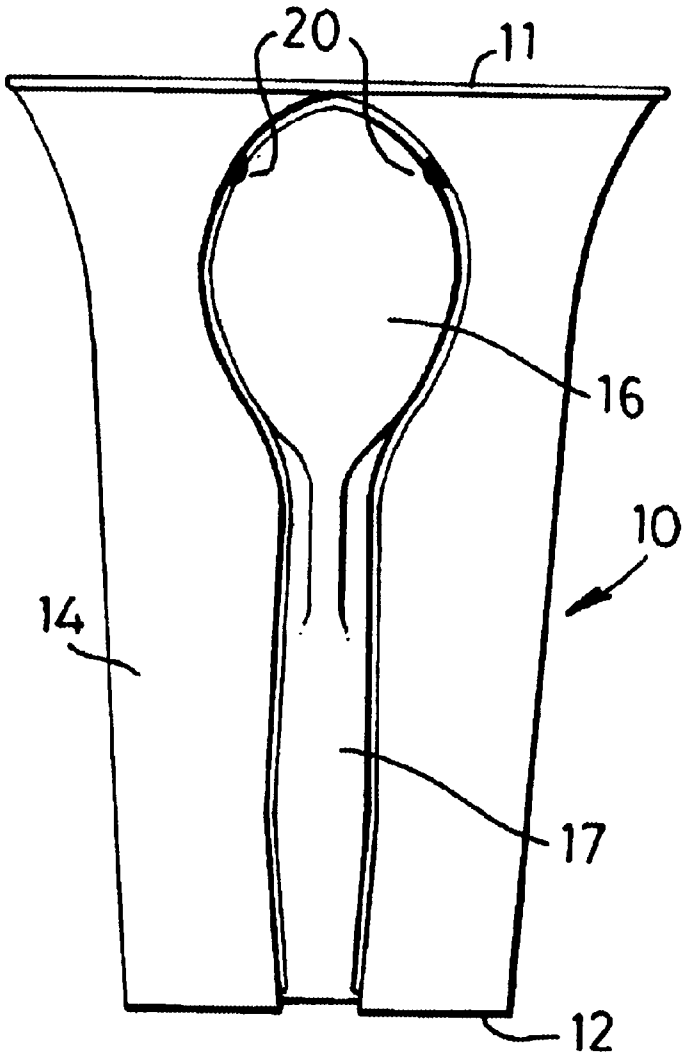
FIG. 1 is a side view of a container with a utensil hinged to the base of the container and not forming part of this invention.
Figure 3:
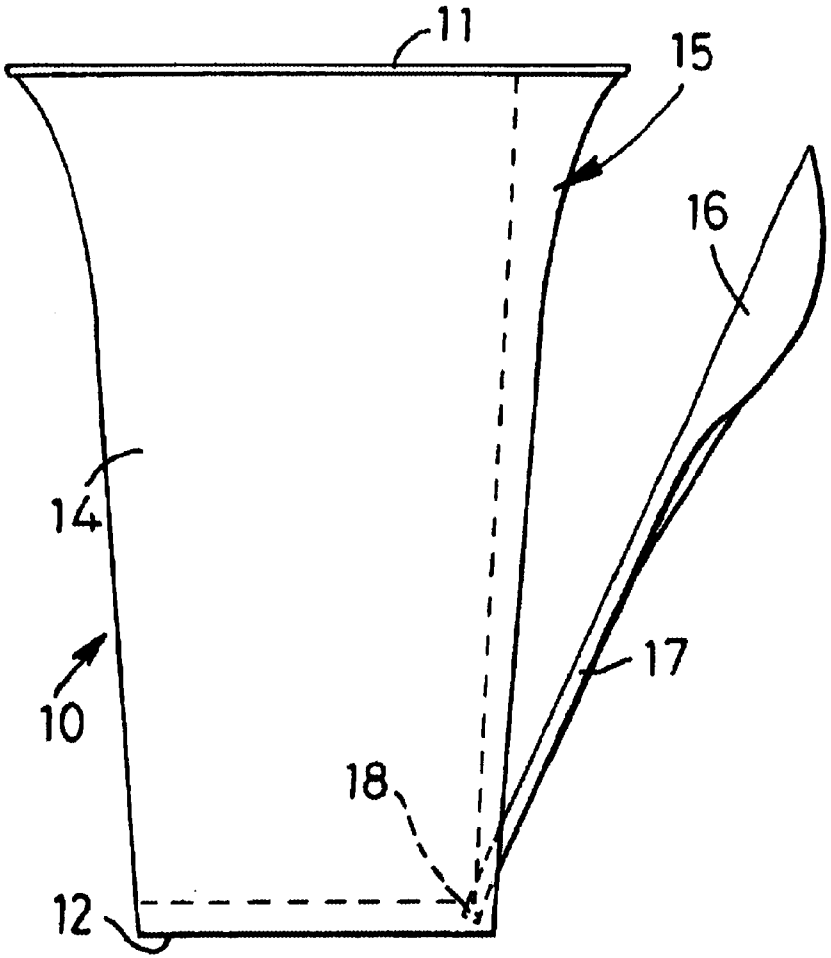
FIG. 3 is a further side view, corresponding to that of FIG. 2, but of a complete product.

Referring initially to FIGS. 1 to 3, there is shown a moulded plastics container 10, for food-stuffs. This container is generally of a conventional shape, and is suitable for the accommodation of a variety of semi-liquid or cream like food-stuffs, such as yoghurts, sundaes, soft cheeses and so on, as well as savoury foods which might need heating or the addition of hot water, such as noodles, pasta and soups. After filling with the food-stuff, the container is sealed by a plastic or metallic lid adhered to the rim 11 around the mouth to the container, in a manner well known in the art.

The container of FIGS. 1 to 3 has a lower rim 12 with a base wall 13 extending across the bottom of the container, the rim projecting downwardly to a small extent beyond the base wall. Moulded in the side wall 14 of the container is a depression 15 generally in the shape of the spoon, the wall defining the depression thus projecting internally of the container. Moulded integrally with the container, at the time of manufacture thereof, is a spoon 16. This spoon is connected at the end of the spoon handle 17 to the container at the junction 18 of the base wall to the side wall, above the lower rim 12 of the container. The connection is by a line of reduced section plastics material such that it forms a frangible hinge which may be broken by hinging movement of the spoon with respect to the container, the weakened line ensuring that the break takes place therealong, without causing inadvertent splitting of the junction between the base and side walls of the container.

The shape of the depression 15 in the side wall 14 closely corresponds to that of the spoon, as best seen in FIG. 1. The clearance between the spoon and the side wall is exaggerated in FIG. 1 and in fact the spoon should be a press-fit in the depression so that the spoon will be retained in the position shown in FIGS. 1 and 2 until a user positively wishes to extract the spoon. Alternatively, or in addition, the edge of the depression may be provided with two or more inwardly directed nibs 20, arranged to retain the spoon in position in the depression until the spoon is deliberately pulled outwardly, for use.

A container for food-stuffs as described above is normally labelled. This may be achieved by direct printing on to the container wall, though a pre-printed self-adhesive label (not shown) may be applied to the container wall, and in this case that label may extend over the spoon so as to retain the spoon in the depression. Alternatively, a shrink-wrap sleeve (not shown) may be fitted to the container and shrunk on to the container wall, that sleeve then serving to hold the spoon in the recess.

Figure 4C:
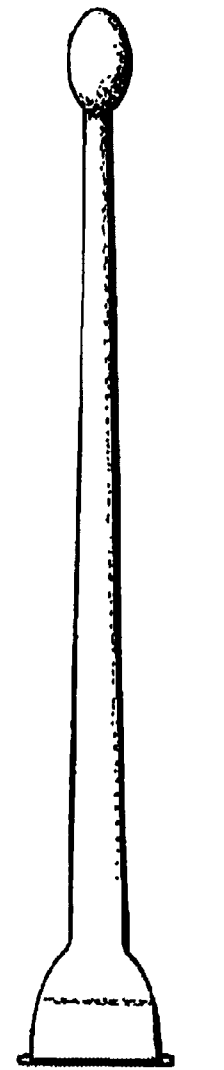
FIGS. 4A, 4B and 4C show three alternative utensils which could be used with a container.
Figure 4B:
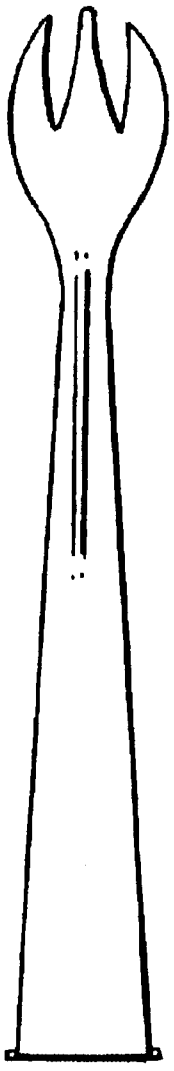
Figure 4A:
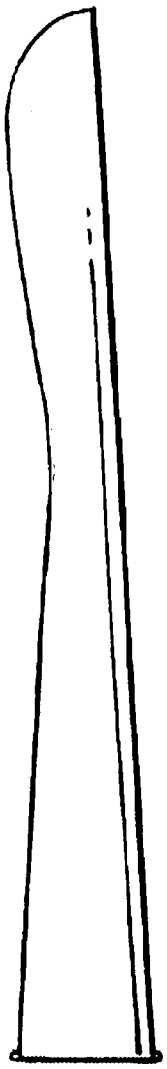

FIGS. 4A, 4B and 4C show respectively a moulded plastics material knife, fork and stirrer, which may be used in conjunction with a container having a suitably profiled depression, instead of the spoon shown in FIGS. 1 to 3. Of course, the container may have two depressions spaced around the wall of the container, with a different utensil in each depression.

Figure 5:
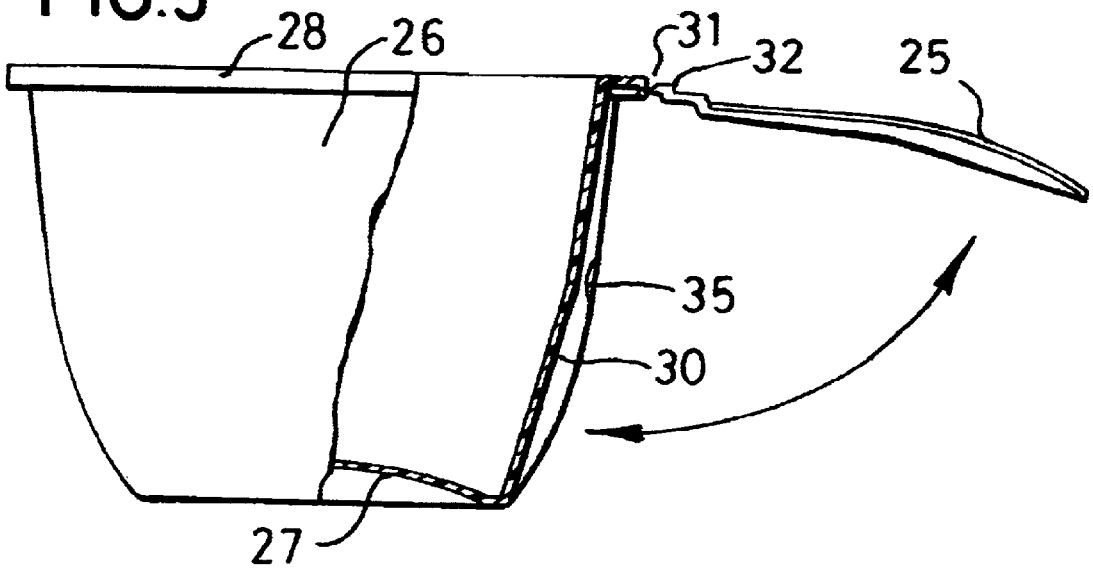
FIG. 5 is a side view, partly in section, through a first embodiment of this invention.

FIGS. 5 to 9 show first embodiment of container, which differs from that of FIGS. 1 to 3 in that the utensil (in this case, a spoon 25) is hinged to the container at the upper rim thereof, rather than adjacent the base. The container shown in FIG. 5 is a simple moulded tub having a side wall 26 and a convex base 27, when viewed from above. The upper end of the side wall 26 has an outwardly turned flange 28 forming a rim for the mouth of the container, there being a plurality of outwardly directed stacking projections 29 (FIG. 9) formed around the rim of the container, to assist the mould cavity eject operation and also to prevent jamming together of stacked empty containers. Thus far, the container is essentially conventional.

Figure 6:
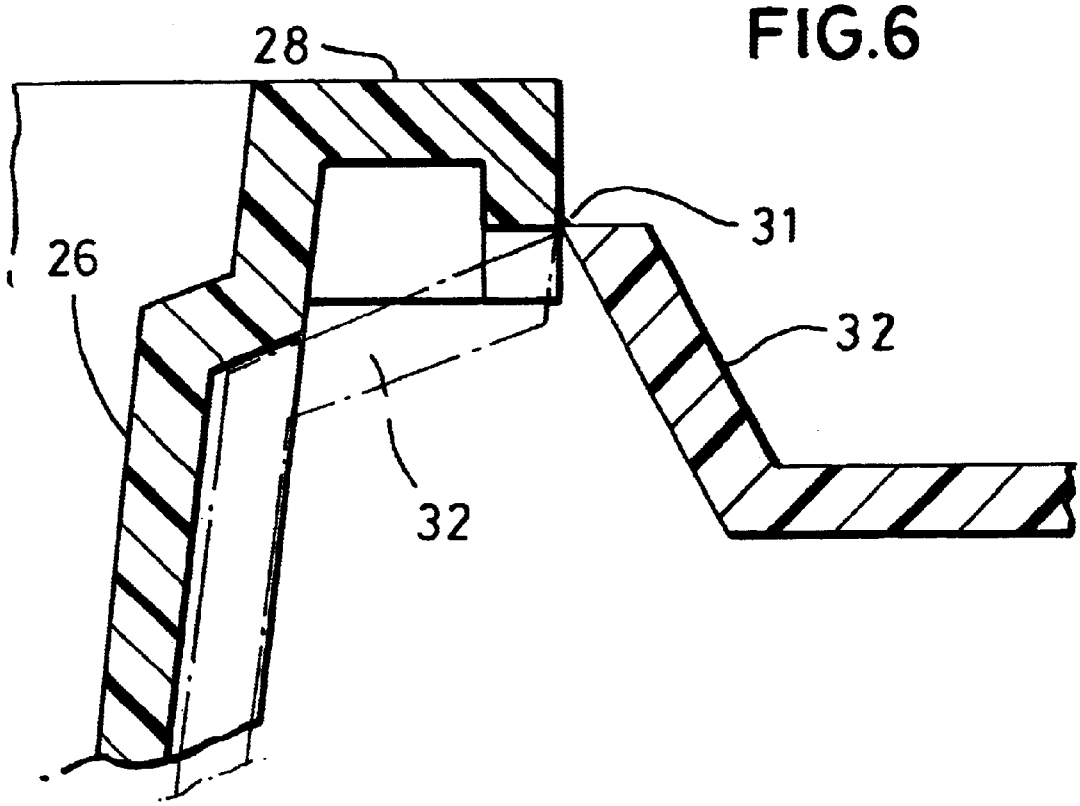
FIG. 6 is a vertical section through the hinge region of the container of FIG. 5.
Figure 7:
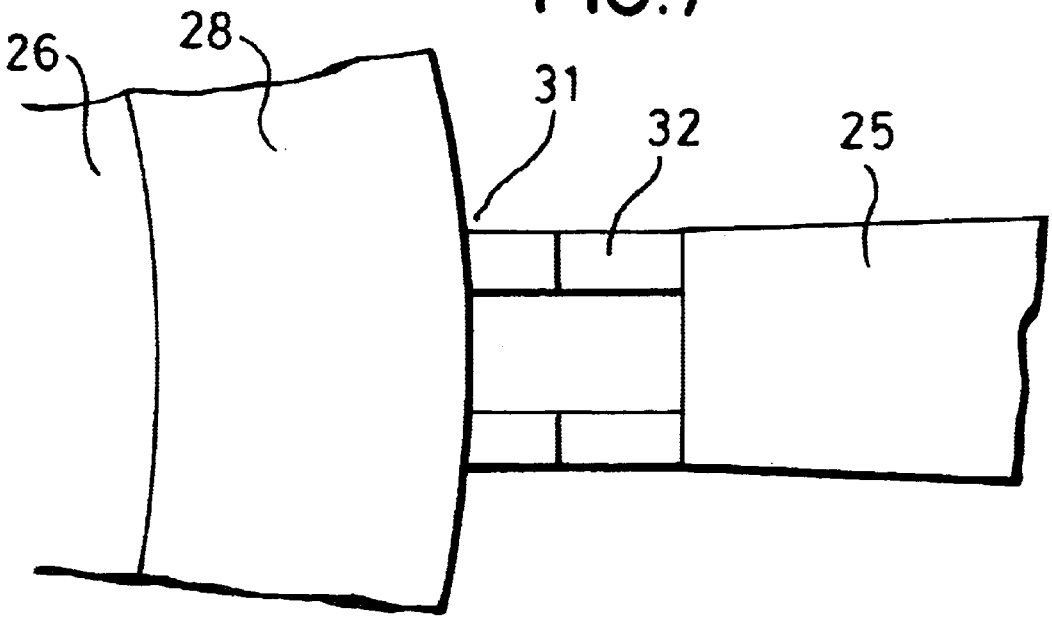
FIG. 7 is a plan view on the detail of FIG. 6.

A depression 30 is moulded integrally in the side wall 26, so as to extend from immediately beneath flange 28 downwardly to the base 27. The depression is of essentially the same shape and dimensions as that of spoon 25, moulded integrally with the container and connected thereto by a frangible hinge 31 which connects the free end of the spoon handle portion 32 to the flange 28. As best seen in FIGS. 6 and 7, that free end 32 is profiled so that when the spoon has been hinged downwardly to lie in the depression 30, the free end fits closely under the flange 28 of the container and then in the depression 30. The material thickness defining hinge 31 is significantly thinner than that of the flange 28 and free end 32 of the spoon handle, whereby the hinge may easily be broken through, to free the spoon from the container.

As moulded, the spoon will project generally radially from the flange 28, as shown in FIGS. 5 to 7. In this configuration, the containers may be stacked one within the other and with the spoons either aligned and so partially nesting with each other, or may be stacked with each spoon angularly spaced from its neighbours. At the time of de-stacking the containers for filling, the spoons may be hinged down, so as to locate in the respective depressions 30, as shown in FIG. 8.

Figure 8:
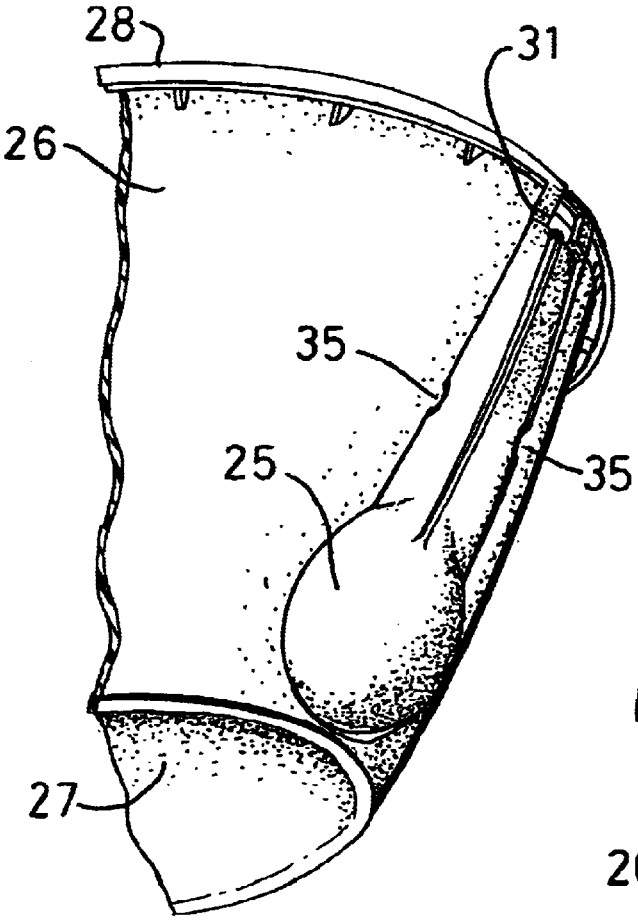
FIG. 8 is a partial perspective view of the container of FIG. 5, showing the utensil in the depression.
Figure 9:
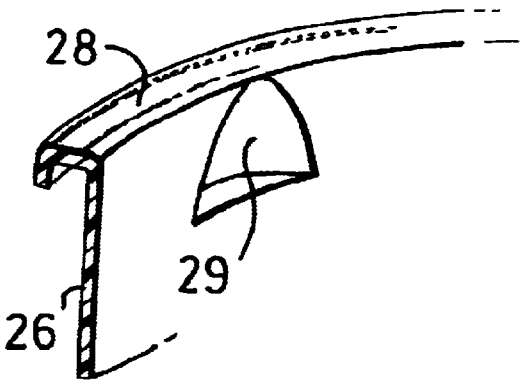
FIG. 9 is a detail view on the container rim.

In FIGS. 5 and 8, there are shown two inwardly directed nibs 35 approximately mid-way along the edges of the side wall 26 which define the depression 30. These nibs are arranged so that the spoon handle may be snap fitted behind the nibs, thereby to retain the spoon in the depression.

As with the arrangement of FIGS. 1 to 3, the container of this embodiment may be decorated or labeled as appropriate, for the intended contents.

Figure 10:
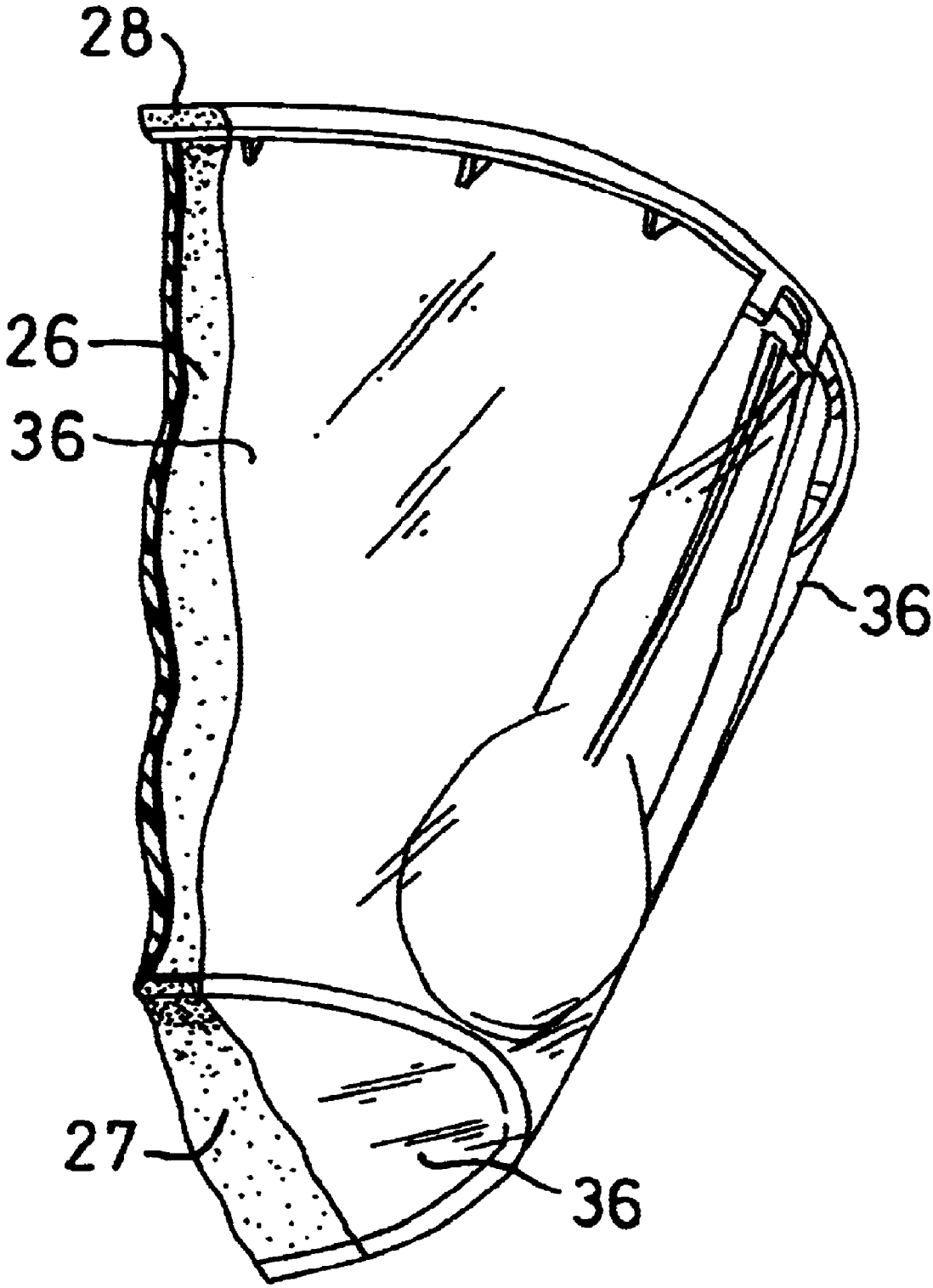
FIG. 10 shows a partial perspective view of the container of FIG. 5, showing the utensil in the depression and covered by a shrink wrap sleeve.

FIG. 10 shows a first embodiment of the container, wherein the covering for the depression is in the form of a shrink-wrap sleeve 36, and which retains the utensil in the depression.

What is claimed is:

1. A food container in the form of a moulded plastic material pot having a base and a side wall upstanding from the base, in combination with a moulded plastics utensil to assist the consumption of the food contents of the container when sold, the container being of generally circular cross-sectional shape and having an integrally moulded outwardly-projecting rim, and the utensil being moulded integrally with the container and connected at one end thereof to the rim of the container, the length of the utensil substantially corresponding to the height of the container and the external surface of the container side wall having an inwardly-directed depression moulded therein to extend substantially from the rim of the container to the base wall of the container, the shape of which depression generally corresponds to that of said utensil so that prior to use the utensil may be located in the depression, and there being a covering for the depression which covering serves to retain the utensil in the depression.

2. A food container as claimed in claim 1, wherein the covering is in the form of a self-adhesive label.

3. A food container as claimed in claim 2, wherein the covering is in the form of a self-adhesive pre-printed label.

4. A food container as claimed in claim 1, wherein the covering is in the form of a shrink-wrap sleeve fitted over the outer surface of the container side wall.

5. A food container as claimed in claim 4, wherein the covering is in the form of a pre-printed shrink-wrap sleeve, shrunk onto the container side wall.

6. A food container as claimed in claim 1, wherein the utensil has a handle and the free end of the handle is connected to the rim of the container.

7. A food container as claimed in claim 1, wherein the utensil is connected to the container by a frangible binge.

8. A food container as claimed in claim 1, wherein the utensil is a press-fit in the depression.

9. A food container as claimed in claim 1, wherein the edge of the side wall around the depression includes at least one nib directed inwardly of the depression whereby the utensil may be pressed behind the nib into the depression to be retained therein by the nib.

10. A food container as claimed in claim 1, wherein the utensil comprises one of a fork, spoon, knife or stirring rod.

11. A food container as claimed in claim 1, wherein more than one utensil is provided, located in a respective depression in the side wall.

12. A food container as claimed in claim 1 in combination with a food-stuff contained within the container, to form a packaged food-stuff with a utensil to assist the consumption of the food stuff.

13. A food container in the form of a molded plastics material pot comprising:

a base wall of generally circular shape;

a side wall upstanding from the base wall and having inner and outer surfaces;

a rim molded integrally with the side wall and projecting outwardly from the upper end thereof;

a depression formed in the outer surface of the side wall and extending from the rim to the base;

a utensil to assist the consumption of food contained in the container, the utensil having a handle end and an implement end and being molded integrally with the container, the length of the utensil between said ends being substantially equal to the length of the side wall from said rim to said base;

a frangible hinge connecting said handle end of the utensil to said rim, said depression being configured for reception of the utensil before use thereof by hinging movement of the utensil with respect to the rim while still connected thereto; and a covering for the depression when the utensil is located therein, which covering is selected from a pre-printed self-adhesive label adhered to said outer surface of the side wall and a pre-printed shrink-wrap sleeve fitted over and shrunk on to the outer surface of the side wall.

* * * * *